US006089066A

United States Patent [19]

Cernuschi et al.

[11] Patent Number: 6,089,066

[45] Date of Patent: Jul. 18, 2000

[54] PROCESS FOR THE PRODUCTION OF SEAMLESS TUBES

[75] Inventors: Ettore Cernuschi, Bareggio, Italy; Gerhard Kulessa, Mllheim, Germany; Thomas Leisten, Hückelhoven, Germany; Jürgen Pietsch, Mönchengladbach, Germany; Walter Randerath, Viersen, Germany; Frank Salomon, Willich, Germany

[73] Assignee: Mannesmann AG, Düsseldorf, Germany

[21] Appl. No.: 09/262,474

[22] Filed: Mar. 4, 1999

[30] Foreign Application Priority Data

Mar. 4, 1998 [IT] Italy ..... MI98A0434

[51] Int. Cl.[7] ..... B21B 19/04

[52] U.S. Cl. ..... 72/97

[58] Field of Search ..... 72/97

[56] References Cited

U.S. PATENT DOCUMENTS 3,550,415 12/1970 Tarenskeen ..... 72/97

FOREIGN PATENT DOCUMENTS 195 20 833 12/1995 Germany .

*Primary Examiner*—Lowell A. Larson

*Attorney, Agent, or Firm*—Cohen, Pontani, Lieberman & Pavane

[57] ABSTRACT

A process for producing a hollow billet for producing tubing for antifriction bearings includes massively reducing a bloom in a three-roll rotary piercing mill and subsequently piercing the reduced bloom in a three-roll rotary piercing mill. The reducing and piercing may be performed in one-pass through the three-roll rotary piercing mill. The reducing and piercing steps may also be performed in separate passes through the same mill or through two separate mills.

7 Claims, 4 Drawing Sheets

PROCESS FOR THE PRODUCTION OF SEAMLESS TUBES

BACKGROUND OF THE INVENTION

1. Field of the Invention

The present invention relates to a process for production of hot-finished tube of carbon, alloyed, and high-alloy steels in which a pretreated, degassed, and deoxidized liquid steel having the required chemical composition is continuously cast, separated into lengths, heated to a forming temperature, and formed in a pipe mill to any circular cross-section. More specifically, the present invention relates to a process for the production of tubing for antifriction bearings.

2. Description of the Related Art

Standardized hypereutectoid steels having a high carbon content are known, for example, by the DIN designation 100Cr6. This material is used to produce hot-finished tubes intended for use as the starting material for manufacturing antifriction bearing rings.

During conventional manufacturing of these tubes, an ingot is cast and rolled to form a tube round in a roughing mill. The tube round is then further processed to produce a hot-finished tube in a mill such, by way of example, as in an Assel mill. The Assel mill is located downstream of a rotary hearth furnace and generally includes a piercing unit comprising a rotary piercing mill for producing a hollow body which is then fed to three evenly distributed grooved peripheral piercer rolls and a bar serving as an internal tool. The hollow body is normally subjected to an intermediate heating and reduced in a multiple-stand reducing mill and a downstream rotary sizer to produce a hot-finished tube. A drawback of this process is that the size of the starting material, i.e., the tube round, must be close to that of the last finished table. Therefore, a large number of sizes of rolled and/or forged tube round materials are required to produce an entire product range of hot-finished tubes.

Other pipe mills such, for example, as push bench plants or mandrel mills, may also be employed instead of Assel mills for producing tubing for antifriction bearings. However, these other mills must always use preformed and homogenized charge material.

Instead of using an ingot, it has been suggested to use a continuously cast bloom that is rolled or forged after it has been cut off. The rolling or forging process must always be preceded by a diffusion annealing to break down or reduce segregations due to the casting process as well as coarse carbide segregations.

The above processes for producing starting materials require capital intensive forming equipment and are accordingly expensive. In addition, the large number of work and transportation stages required for these processes entail the risk of generating additional faults and/or intensifying existing ones. These faults must be eliminated at additional cost.

A search for further processes uncovered another prior art process for producing hot-finished tube made from a high-carbon steel such, for example, as hypereutectoid steel, disclosed in German reference DE 195 20 833 A1. This process offers a cost advantage over the other known processes and allows a better utilization of the material while reducing the processing times. The essence of this process includes the employment of unformed vertically cast strand or a strand cast in a bow-type continuous caster made from steel of any cross-section, particularly steel belonging to the material group of antifriction in a pipe mill without requiring the customary upstream rolling and forging processes of the homogenizing treatment. The elimination of these work stages produces a considerable savings in terms of both time and money. In addition, this process produces an improved utilization of materials because the material does not have to be separated and cropped as often.

After being separated into charge lengths, a continuously cast bloom produced in accordance with this process is heated to a forming temperature without preliminary forming and fed to a piercing press. The continuously cast bloom may also be fed to an elongator and a push bench after passing through the piercing press. A 2-roll cone-type piercer may be used preceding a mandrel mill or a plug rolling mill. It is known in the art that creating a tensile state with a minimized amount of tensile stresses in the workpiece eliminates the risk of having the workpiece burst during the piercing process. However, it is not known how to minimize the tensile stresses when a cone-type piercer is used.

Minimizing the tensile stresses would be of special importance in the 2-roll cross-rolling process because this process is characterized by a high degree of tensile stresses in the area of the billet core which may lead to bursting of the billet core when a solid billet is cross-rolled without an internal tool or with a maladjusted internal tool. This stress characteristic of the 2-roll cross-rolling as well as the resultant "reeling effect", which causes the core zone to break up and leads to internal surface defects of the rolled hollow billet during 2-roll cross-rolling of the unformed 100Cr6 cast strand, are described in literature and known to those skilled in the art.

SUMMARY OF THE INVENTION

On the basis of the known process for producing hot-finished tube out of high carbon steel such, for example, as hypereutectoid steel using an unformed cast strand, it is an object of the present invention to eliminate or at least minimize the amount of tensile stresses in the core zone of a workpiece to eliminate the risk of having the workpiece burst, thereby permitting the simple production of alloyed and high-alloy steel pipe and tube, especially high quality tubing for antifriction bearings, in Assel mills and other pipe mills at a reduced starting material cost.

To solve the problem of the prior art, the present invention preforms a continuous cast bloom in a 3-roll rotary piercing mill through a massive reduction and pierces the massively reduced bloom immediately afterward in a 3-roll rotary piercing mill with an axially fixed piercing mandrel to form a hollow billet.

In contrast to the two-roll cross-rolling process which causes a stress condition that produces a high degree of tensile stresses in the billet center which facilitates a potential bursting of the billet core, the three-roll cross-rolling process exerts only compressive stresses on the billet core, thereby preventing a destruction of the workpiece. The inventive process includes the steps of forming a continuously cast starting material such, for example, as 100Cr6 by massive reduction using a three-roll rotary piercing mill and piercing the continuously cast starting material after the massive reduction in the same three-roll rotary piercing mill to form the hollow billet needed for stretch rolling.

The favorable tensile state of the three-roll process compacts the core area of the cast strand instead of tending to burst it. Another feature of the present invention is that the continuously cast bloom can be preformed and pierced in the same three-roll rotary piercing mill provided with suitably grooved rolls. This feature considerably simplifies the system required to produce the hollow billet and consequently reduces its price.

According to the invention, the steps of massive reducing and piercing may take place either in one pass or two passes through the three-roll rotary mill. When the one-pass embodiment of the inventive process is used, the workpiece is fed in a rolling direction to the three-roll rotary mill and is massively reduced. As the workpiece continues through the three-roll rotary mill, it is pierced by a mandrel to form the hollow billet immediately after being massively reduced. When the two pass embodiment is used, the workpiece is massively reduced by the three-roll rotary mill as it passes in one direction and is pierced to form the hollow billet as the workpiece passes through the three-roll rotary mill in the reverse direction.

Both the one-pass and the two-pass embodiments of the present invention require one power pack for performing both steps because they can be done in the same three-roll rotary mill resulting in low investment cost. A higher tonnage is achievable using the one-pass process. However, the two-pass embodiment exerts less stress on the workpiece because the diameter development of the roll, i.e., increasing or decreasing, is adjusted to the step being performed on the workpiece. For the first step, the rolls are convergent for massively reducing the workpiece. In the second step, in the reverse direction, the rolls are divergent relative to the travel of the workpiece. The divergence of the rolls causes less stress because a slight expansion of the workpiece is usually associated with the step of piercing. The expansion is hindered in the one-pass embodiment by the convergent rolls, thereby causing higher stress.

It is also possible to perform the two-pass embodiment on two separate three-roll rotary piercing mills arranged one behind the other. This involves higher investment costs and increased heat loss. The benefits are a reduced cycle time. In addition, the roll grooves on the rolls in each three-roll rotary piercing mill may be optimized for the specific task of each mill. This allows the process to be more flexible in the hollow billet sizes that can be produced.

The massive reduction in the continuously cast bloom should amount to approximately 50% to 80% of the initial cross-section of the continuously cast bloom.

In the preferred embodiment, an angle $\alpha_1$ on the inlet side between a surface of the continuously cast bloom and one surface line of each of the rolls is from 3 to 13 degrees and is preferably from 10 to 12 degrees. These angles ensure that the workpiece is properly held and pulled through the mill and ensure that the rolls do not have to be longer than required.

The three-roll rotary piercing mill should preferably comprise cone-type rolls allowing the diameter development of the roll to be adapted to that of the workpiece. According to the two pass embodiment of the invention, the rolls are movable to a divergent position for piercing and to a convergent position for the step of reducing.

The invention allows a directly cast strand of antifriction bearing steel to be used as the starting material in an Assel mill. High-alloy austentitic-type steels may also be used. The high costs previously incurred by preliminary forming of 100Cr6 billets as well as billets of other alloyed and high-alloy steels to tube rounds in roughing mills or forging machines is avoided. The amount of different billet sizes required to produce the customary range of finished sizes may be reduced from 5–10 billets to 1–3 billets. In addition, the smallest size range of billets produced by the continuous caster may be increased from 130 to 160–180 mm. This allows a reduction in raw material costs, simplifies the continuous casting process, and reduces warehousing costs due to the savings in tools.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
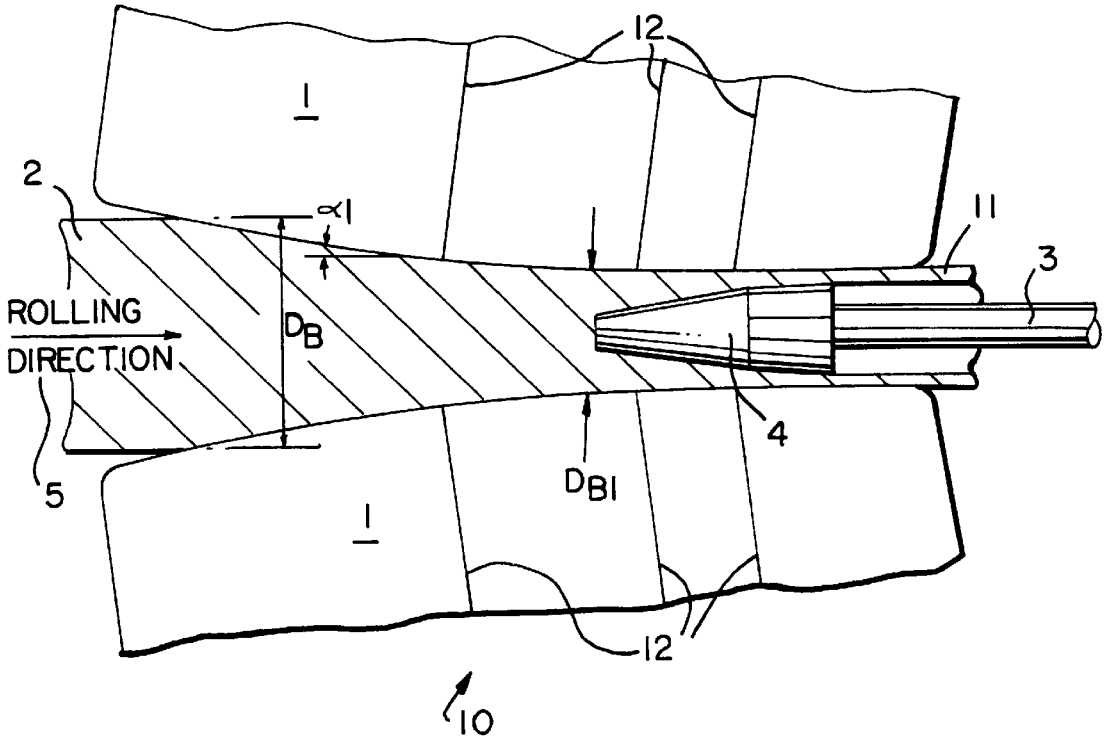
FIG. 1 is a partial cross-sectional view of a three-roll rotary piercing mill showing a one-step embodiment of the present invention.

Referring to FIG. 1, a three-roll cone-type rotary piercing mill 10 is shown in cross-section such that only two of three rolls 1 are shown. FIG. 1 shows the piercing mill 10 being used during a one-pass embodiment of the invention in which a billet 2 is introduced into the piercing mill 10 in the direction of arrow 5. The billet 2 is formed by continuous casting from a pretreated, degassed, and deoxidized liquid steel. The steel is preferably carbon steel, alloyed steel, or liquid-alloy steel. The billet 2 undergoes a massive reduction from beginning diameter $D_B$ to end diameter $D_{B1}$. The rolls 1 are convergent along the direction 5. Immediately after the billet 2 is reduced and while it is still in the piercing mill 10, the billet 2 is pierced over a fixed, freely rotatable mandrel 4 mounted on a mandrel bar 3 for forming a hollow billet 11.

An angle $\alpha_1$, on the inlet side between a line parallel to a surface of the continuously cast billet 2 and one surface line of the rolls 1 is from 3 to 13 degrees and is preferably from 10 to 12 degrees. These angles ensure that the billet 2 is properly held and pulled through the mill 10 and ensure that the rolls 1 do not have to be longer than required. The rolls 1 include grooves 12 for facilitating the holding and pulling of the billet 2 through the mill 10.

Figure 2:
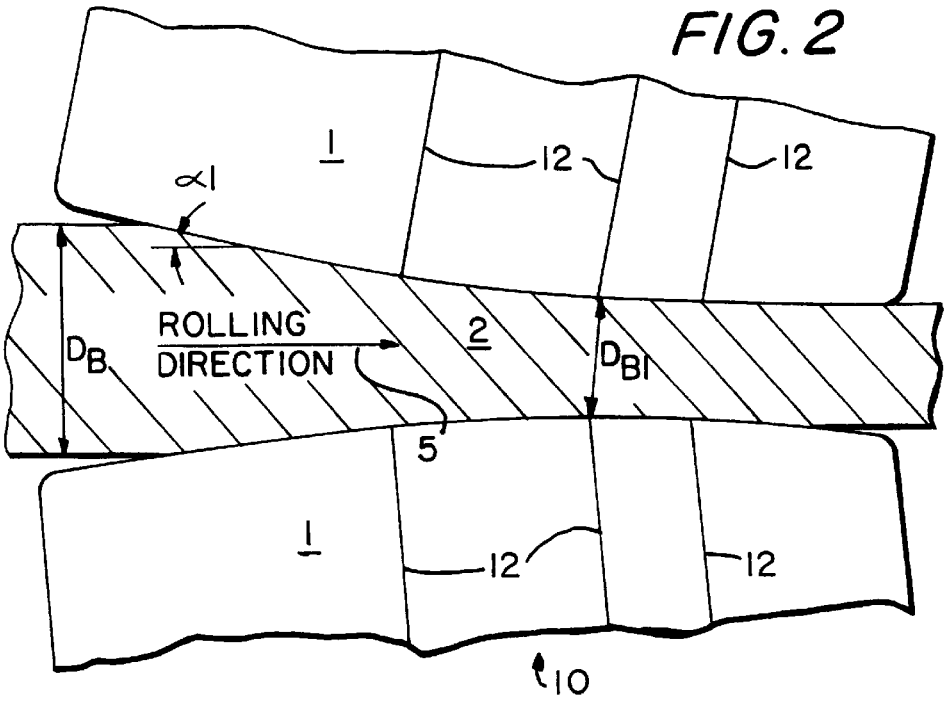
FIG. 2 is a partial cross-sectional view of the three-roll rotary piercing mill of FIG. 1 showing a reduction step of a two-pass embodiment of the present invention.
Figure 3:
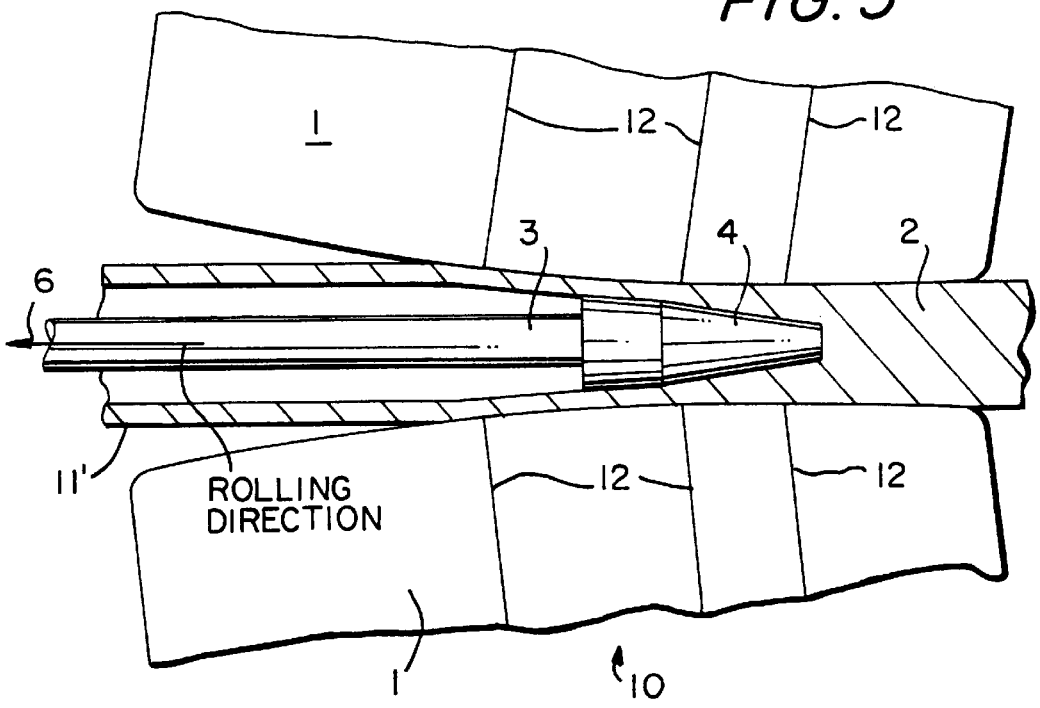
FIG. 3 is a partial cross-sectional view of the three-roll rotary piercing mill of FIG. 1 showing a piercing step of a two-pass embodiment of the present invention.

FIGS. 2 and 3 respectively show the two steps of a two-pass embodiment of the present invention. As in FIG. 1, FIG. 2 is a cross-section of the three-roll cove-type rotary piercing mill such that only two of the three rolls are shown. The billet 2 travels from left to right along the direction indicated by the arrow 5. The billet 2 is massively reduced from beginning diameter $D_B$ to end diameter $D_{B1}$ as it passes through the mill 10. In FIG. 3, after the billet 2 has passed though the mill 10 in the direction of the arrow 5, the billet 2 is fed back into the mill 10 in a reverse pass in the direction indicated by arrow 6. In this second pass the billet 2, which has already been reduced, is pierced by the mandrel 4 held by mandrel bar 3. In this embodiment, the billet 2 is allowed to expand slightly as it passes over the mandrel 4, thereby reducing the stress on the resulting hollow billet 11' compared to the stress on the hollow billet 11 formed in FIG. 1.

Figure 4:
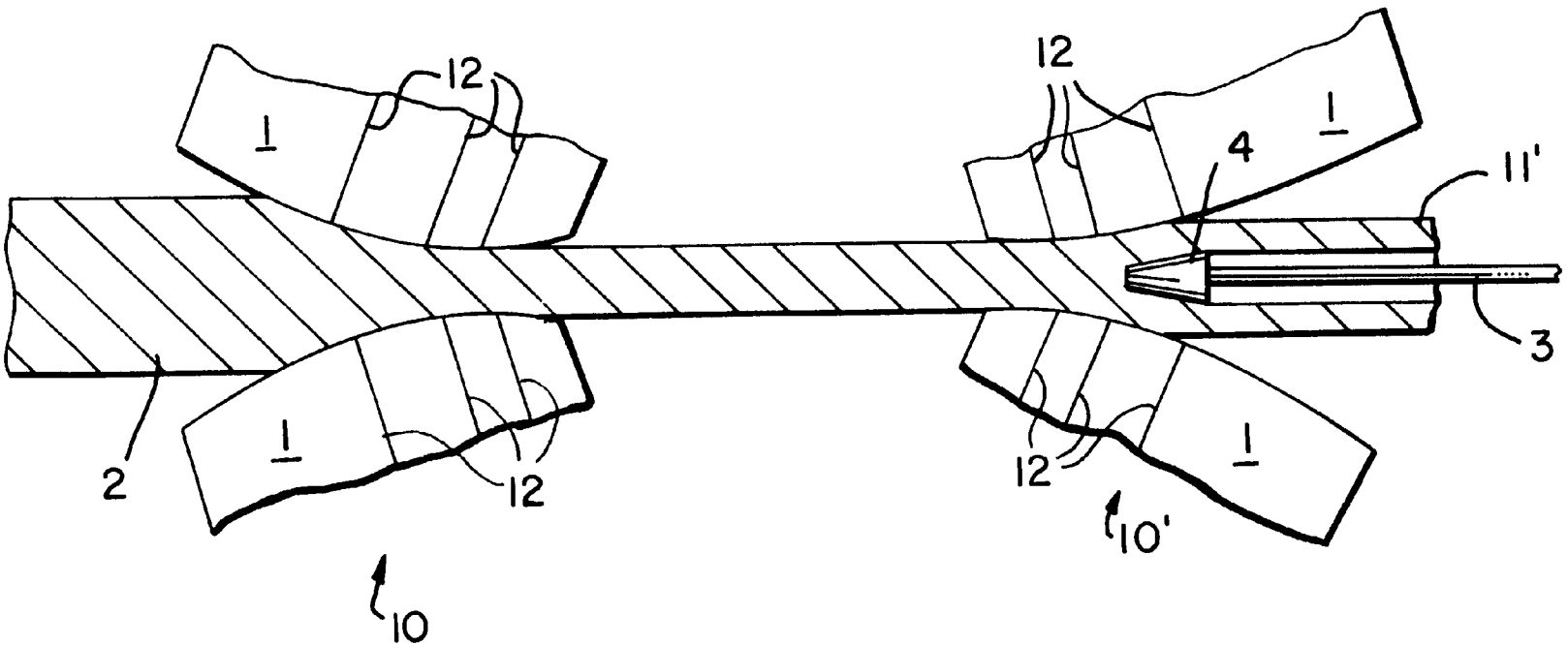
FIG. 4 is a partial cross-sectional view of two three-roll rotary piercing mills, each performing one pass of the two-pass embodiment.

In FIG. 4 the two-pass embodiment of the process is shown using two sequential mills 10, 10' for respectively performing the massive reduction and the piercing of the billet 2 to form a hollow billet 11'. In this embodiment, the grooves 12 of the rolls 1 are optimally configured for performing the massive reduction step and the grooves 12*a* of the rolls 1*a* are optimally configured for performing the piercing step.

Figure 5:
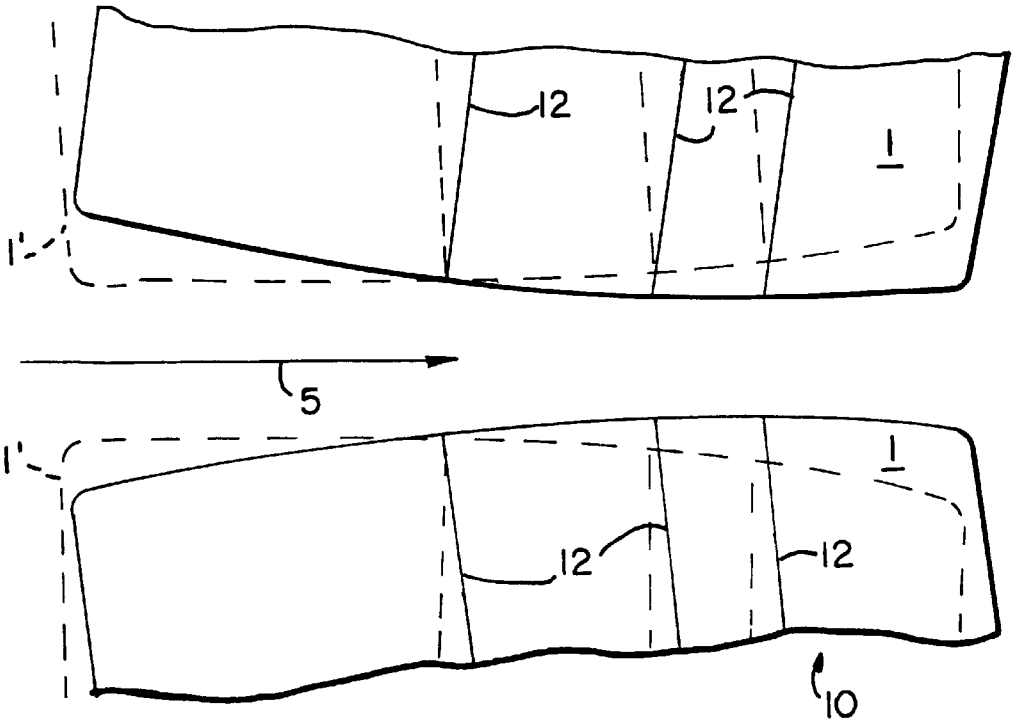
FIG. 5 is a partial cross-sectional view of the three-roll rotary piercing mill showing convergent and divergent positions of the rolls with respect to one rolling direction.

FIG. 5 shows that the rolls 1 are arrangeable such that the rolls may have a convergent profile as shown by the position of the rolls 1 or may be adjusted to have a divergent profile as shown by the position of the rolls 1' with respect to the rolling direction indicated by arrow 5. The adjustability of the profile of the rolls 1 allows the mill 10 to be used for either step of the two-pass embodiment independent of the rolling direction. Although the rolls 1 are preferably divergent for the step of piercing and convergent for the step of massively reducing the rolls may also be oppositely arranged such that the rolls are convergent for the step of piercing and divergent for the step of massively reducing.

The invention is not limited by the embodiments described above which are presented as examples only but can be modified in various ways within the scope of protection defined by the appended patent claims.

We claim:

1. A process for producing a hot-finished tube of steel comprising the steps of:

feeding a bloom to a three-roll rotary piercing mill, the bloom having been continuously cast from pretreated, degassed, and deoxidized liquid steel comprising one of carbon steel, alloyed steel and high-alloy steel, separated into charge lengths, and heated to a forming temperature;

massively reducing the bloom in the three-roll rotary piercing mill for forming a massively reduced bloom by reducing a cross-sectional area of the bloom to an amount within the range including 50% to 80% of the original cross-sectional area of the bloom; and piercing the massively reduced bloom with an axially fixed piercing mandrel in the three-roll piercing mill to form a hollow billet.

2. The process of step 1, further comprising the steps of:

performing said steps of massively reducing and piercing in the same three-roll rotary piercing mill; and providing suitable grooves on the rolls of the three-roll rotary piercing mill.

3. The process of claim 1, further comprising the step of performing said steps of massively reducing and piercing in one pass through the three-roll rotary piercing mill in one rolling direction of the bloom.

4. The process of claim 1, further comprising the steps of:

performing said step of massively reducing in a first pass through the three-roll rotary piercing mill in a first rolling direction such that said rolls roll in a first direction; and performing said step of piercing in a second pass through said three-roll rotary piercing mill in a second rolling direction that is a reverse pass of said first rolling direction such that said rolls rotate in a reverse direction of said first direction.

5. The process of claim 1, wherein said step of massively reducing is performed on a first three-roll rotary piercing mill and said step of piercing is performed on a second three-roll rotary piercing mill.

6. The process off claim 1, wherein said step of feeding further comprises arranging the rolls of the three-roll rotary piercing mill so that a surface of the rolls and a surface of the bloom form an angle within the range including 3 to 13 degrees.

7. The process of claim 6, wherein said step of arranging comprises arranging the rolls of the three-roll rotary piercing mill so that a surface of the rolls and a surface of the bloom form an angle within the range including 10 to 12 degrees.

* * * * *